United States Patent [19]

Hildreth et al.

[11] Patent Number: 4,759,877

[45] Date of Patent: Jul. 26, 1988

[54] NON-IONIC SURFACTANT BASED DETERGENT FORMULATIONS WITH SHORT CHAIN AMPHOTERIC ADDITIVES

[76] Inventors: E. D. Hildreth, Dill Road, R.D. 3, Belleville, Ohio 44813; Karl Heyman, 10 Crestmont Rd. 3M, Montclair, N.J. 07074

[21] Appl. No.: 892,772

[22] Filed: Jul. 31, 1986

[51] Int. Cl.[4] ..... C11D 1/62

[52] U.S. Cl. ..... 252/547; 252/174.21; 252/544; 252/DIG. 14

[58] Field of Search ..... 252/524, 542, 544, 545, 252/546, 547, 174.21, DIG. 14

[56] References Cited

U.S. PATENT DOCUMENTS

| | | | |
|---|---|---|---|
| 3,876,563 | 4/1975 | Collins | 252/545 |
| 3,925,241 | 12/1975 | Schmolka | 252/545 |
| 3,928,251 | 12/1975 | Bolich, Jr. et al. | 252/545 |
| 3,935,130 | 1/1976 | Hirano et al. | 252/545 |
| 4,000,092 | 12/1976 | Wentler | 252/545 |
| 4,002,579 | 1/1977 | Mizutani et al. | 252/544 |
| 4,087,387 | 5/1987 | Willems et al. | 252/545 |
| 4,092,272 | 5/1978 | Nishimura et al. | 252/544 |

OTHER PUBLICATIONS

Tergitol Specialty Surfactants, Ethylene Oxide Derivatives, Union Carbide, 1981.

Tergitol NP Nonionic Surfactants, Ethylene Oxide Derivatives, Union Carbide, 1980.

Amphoterics, Monateric Surfactants, Mona Industries Inc., Oct. 1982.

Monamines & Monamids, Mona Industries, Inc., Apr. 1982.

Monamid 705, Cocamide DEA, Mona Industries Inc., May 1985.

Monamid 1087, Cocamiode DEA, Mona Industries Inc., Apr. 1987.

Emulphogene BC Nonionic Surfactants, A series of ethoxylated tridecyl alcohols, GAF Corp. U.S.A.

*Primary Examiner*—A. Lionel Clingman

*Assistant Examiner*—Hoa Van Le

*Attorney, Agent, or Firm*—Oldham, Oldham & Weber Co.

[57] ABSTRACT

A non-ionic surfactant detergent formulation comprising a detergent and additives to improve the properties of the detergent and wherein the detergent comprises a non-ionic surfactant, and the additive comprises a zwitterionic surfactant carrying at least one hydrophobic group having a straight or branched aliphatic chain of 5 to 9 carbon atoms and at least one aliphatic substituent carrying an anionic water-solubilizing group.

1 Claim, No Drawings

NON-IONIC SURFACTANT BASED DETERGENT FORMULATIONS WITH SHORT CHAIN AMPHOTERIC ADDITIVES

BACKGROUND OF THE DISCLOSURE

The invention is concerned with detergent formulations comprising detergents and additives to improve properties of the detergents. In particular the inventive additives substitute for known so-called "softening", "whitening" and "anti-cling" (anti-static) agents.

Substantial development work takes place continuously to improve the performance of cleaners, particularly home laundry detergents. This is apparent from the information which can be gleaned from patents and the scientific and trade literature. Much attention is directed towards better soil removal; however simplifying the washing procedure is also considered important to the consumer. If cleaning, softening, and the reduction or elimination of static charges can be accomplished simultaneously with a single detergent composition (eliminating the addition of special chemicals to the rinse water), time and effort and expense will be saved in home laundry chores to the delight of the homemakers.

It is therefore an object of the invention to provide a simple detergent formulation that results in improved cleaning, while softening the fabrics being laundered and providing anticling or antistatic action.

The chemicals now required to accomplish these objects are numerous, and the manufacture of the finished laundry products often is tedious and difficult. Formulations have been described with as many as at least 17 different components, Embodiment IV of the European Patent Application No. 0,111,976, page 34 (1984) or at least 18 ingredients in Example IV of U.S. Pat. No. 4,515,705 (1984), not including minor additives and water. For many years, the art has taught that for good performance compounds with hydrocarbon chains of 12 carbon atoms and over, preferably of 16–18 carbon atoms must be used for laundry detergent additives for softening the laundry. This is evident from the scientific literature and also from the fact that the examples given in the patent literature always list carbon chains with 12 to 18 carbon atoms, predominantly 14 to 18 carbon atoms.

One of the most effective prior art softeners is dimethyl-dialkylammonium chloride where the dialkyls are either tallow or stearyl radicals:

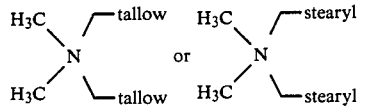

containing a total chain length of $C_{36}$ interrupted, however, by the quaternary nitrogen which may decrease the softening effect to some extent.

Furthermore, technical books which deal directly with textile softeners direct persons skilled in the art to long chain compounds. Most to the point is perhaps the statement in "Handbuch der Textilhilfsmittel", Verlag Chemie 1977 which, in the last paragraph of page 685 dealing with Chemical Constitution of the Softeners states that in practice the compounds based on fat-oil-, and silicon derivatives are predominantly used. As a rule these substances have one common characteristic: they have all a long-chain fat residue (according to rule they are products with a carbon number of between 16 and 18), which cause the softening action.

In the text "An Introduction to Texile Finishing" by English textile chemist J. T. Marsh (1966 edition) there is a general oveview of "Softening" in Chapter X. Specifically at page 260 last paragraph Marsh states that although many hundreds of preparations are available for softening textile materials, it is noteworthy that they are all based on long-chain fatty compounds in one guise or another. Long chain fatty compounds are generally those which contain 12 and more carbons in the chain. Soaps, oils, fats and waxes have usually 16 to 18 and more carbon atoms in their chain. Coconut is the primary exception: however this oil has fatty acids with the fractions with longer chains containing 12 and more carbon atoms generally amounting to over 80% of the total. Thus the presence of $C_4$ to $C_{10}$ chains if mentioned in any prior art compilations, refers to their presence in coconut oil, where they play a very minor role.

On page 264 Marsh further points out the use of tallow for many years has shown the importance of a fatty chain of 16 to 18 carbon atoms.

Finally, at page 271 under "Cation-active Softeners" (to which the imidazolines of this invention belong) it is taught that modern cation-active softeners appear to originate from attempts made in 1933 to improve the fastness of acid and direct dyestuffs by forming a lake; the short-chain cation-active bodies were relatively ineffective but the long-chain compounds were better and also imparted a highly desirable softness of handle for which they are now mainly used.

BRIEF DESCRIPTION OF THE INVENTION

Simple liquid detergent formulations are described which are composed of only nonionic and short chain zwitterionic surfactants with 9 or less carbon atoms (usually down to 5).

When using such formulations, white fabrics appear clean and white at the end of the rinse cycle, making soil anti-redeposition additives unnecessary and bleach required only in severe cases. Furthermore anti-static and fabric softener properties were also exhibited. Cottons laundered with the inventive compositions were found to absorb moisture voraciously.

The fact alone that short chain zwitterionic compounds can act as fabric softeners is totally unexpected. Added to this are the enhanced cleaning and the antistatic properties found for the inventive compositions.

DETAILED DESCRIPTION

Textile chemists expect "fabric softening" to be achieved with quaternary ammonium compounds carrying long chains, preferably sixteen to eighteen carbon atoms. This is explained by the mode of action of these compounds whereby the positively charged cations attach themselves to the negatively charged surfaces of the substrates. One can visualize the long chains aligning themselves in a organized fashion like the fibers on the surface of a piece of velvet. Even the character of the fatty radicals is reflected in the feel or "hand" of the softened textile material. The rigidity of the stearyl radical gives a crisp feel, whereas tallow or oleyl result in a more sleezy feel or "hand".

The softening action of zwitterionic surfactants with long chain substitutents has been reported and could be expected from the known activity of tertiary and quaternary ammonium compounds. The similar action of the short chain zwitterionics cannot be explained at this time. However, because of the short chains, they have the great advantage of not leaving a "fatty" (long chain) film on the clothes, with the result that water repellency in the laundered fabric is avoided. It explains however the observed result that cottons for example become especially water absorbent.

Equally surprising is the repression and prevention of static electricity when the short chain zwitterionics are part of the formulations. The commonly used antistats are identical with or similar to fabric softeners. Long chain radicals as part of the molecule are considered essential. Again, the lack of a fatty build up on the wash (which would increase the water repellancy) is a welcome advantage when using the short chain zwitterionic compounds.

The synergistic effect of the short chain zwitterionic compounds on the cleaning power of nonionic detergents could likewise not have been foreseen.

Thus, the invention is in the use of zwitterionic compounds as additives to nonionic surfactants or detergents.

If desired customary secondary additives may be used such as optical bleaches, enzymes, fragrances, colors and the like.

THE NONIONIC SURFACTANTS

Suitable nonionic surface active agents have been available at least from the 1930's and have seen a very substantial growth accompanied with a prolific issue of patents and articles in the scientific and trade literature. They act alone to remove fatty soil and they are effective suspending agents for particulate soil which is normally present in clothes from dust or the daily surroundings and redeposited in the laundering process.

Nonionic surfactants do not ionize in water and there seems to be little interference with other chemicals contained in a formulation using them. This makes compounding with these materials quite easy. Though it is difficult to incorporate them into powder detergents because they are liquids, liquid heavy duty home laundering detergents are increasingly being used.

The present invention provides a laundry formulation using known nonionic surfactants or detergents. Suitable for use are detergents such as those generally disclosed in the European Patent Publication No. 0,111,976 filed Dec. 14, 1983, pages 19 to 23. Classes included are:

1. The polyethyleneoxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation, and Triton X-45, X-114, X-100, and X-102, all marketed by the Rohm + Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms). Examples of commercially available nonionic surfactants of this type include Tergitol 15-S-9, marketed by Union Carbide Corporation, Neodol 45-9, Neodol 23-6.5, Neodol 45-7, and Neodol 45-4, marketed by Shell Chemical Company, and Kyro EOB, marketed by the Procter + Gamble Company.

3. The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, the moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

5. Semi-polar nonionic detergent surfactants which include water-soluble amine oxides containing one alkyl moiety of from about 10–18 carbon atoms; and moieties selected from the group consisting of alkyl groups and hydroxyalkyl groups containing from 1 to about 3 carbon atoms; water-soluble phosphine oxides containing one alkyl moiety from about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred semi-polar nonionic detergent surfactants are the amine oxide detergent surfactants having the formula $$R^3(OR^4)_xNR^5{}_2^{\overset{O}{|}}$$

wherein $R^3$ is an alkyl, hydroxyalkyl, or alkyl phenyl group or mixtures thereof containing from about 8 to 22 carbon atoms; $R^4$ is an alkylene or hydroxyalkylene group containing from 2 to 3 carbon atoms or mixtures thereof; x is from 0 to 3; and each $R^5$ is an alkyl or hydroxyalkyl group containing from 1 to about 3 carbon atoms or a polyethylene oxide group containing from one to about 3 ethylene oxide groups. The $R^5$ groups can be attached to each other, e.g., through an oxygen or nitrogen atom to form a ring structure.

Preferred amine oxide detergent surfactants are $C_{10}$–$C_{18}$ alkyl dimethyl amine oxide and $C_8$–$C_{12}$ alkoxy ethyl dihydroxy ethyl amine oxide.

6. Alkylpolysaccharides disclosed in European Patent Application No. 82200868.6 filed July 12, 1982, R. A. Llenado, having a hydrophobic group containing from about 6 to about 30 carbon atoms and a polysaccharide, e.g., a polyglycoside, hydrophilic group containing from about 1½ to about 10, preferably from about 1½ to about 3, most preferably from about 1.6 to about 2.7 saccharide units. Any reducing saccharide containing 5 to 6 carbon atoms can be used, e.g. glucose, galactose and galactosyl moieties can be substituted for the glycosyl moieties. (Optionally the hydrophobic group is attached at the 2, 3, 4, etc. positions thus giving a glucose or galactose as opposed to a glucoside or galactoside.) The intersaccharide bonds can be, e.g., between the one position of the additional saccharide units and the 2-, 3-, 4-, and/or 6 positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to 3 hydroxy groups and/or the polyalkyleneoxide chain can contain up to 3 hydroxy groups and/or the polyalkyleneoxide chain can contain up to about 10, preferably less than 5, most preferably 0, alkyleneoxide moieties. Suitable alkyl polysaccharides are octyl, nonyldecyl, undecyldodecyl, tridecyl, tetradecyl, pentadecyl, hexadecyl, heptadecyl, and oxtadecyl, di-, tri-, tetra-, penta-, and hexaglucosides, galactosides, lactosides, glucoses, fructosides, fructoses, and/or galactoses. Suitable mixtures include coconut alkyl, di-, tri-, tetra-, and pentaglucosides and tallow alkyl, tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from 1½ to about 10, preferably from about 1½ to about 3, most preferably from about 1.6 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4-, and/or 6-position, preferably predominately the 2-position.

7. Fatty acid amide detergent surfactants having the formula:

$$R^6{-}\overset{\overset{O}{\|}}{C}{-}NR^7{}_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanol amides.

As can be seen from the above listing many types of nonionic surfactants exist, but the largest number presently produced use ethyleneoxide for the building of the hydrophilic portion of the molecule. The preferred species for this invention are those described in groups 1, 2, 3 and 7.

Nonionic surfactants are good wetters and excellent emulsifiers, dispersing agents and solubilizers. A factor which contributes to this behavior is a very low critical micelle concentration in the order of $10^{-4}$ mol/liter which is characteristic for this type of chemicals. It allows their use in smaller concentration which brings them price-wise to the level of the industry work horses, namely the alkyl-aryl or alpha-olefinsulfonates.

Nonionic surfactants also are able to prevent to a certain degree the redeposition of soil during the laundering operation which leads to a greying of white goods like cotton and particularly of synthetic fibers like polyester or nylon.

SHORT CHAIN ZWITTERIONIC SURFACTANTS

The short chain zwitterionic surfactants used in this invention belong to the groups generally described as derivatives of secondary and tertiary amines, heterocyclic secondary and tertiary amines, or derivatives of quaternary ammonium and phosphonium or tertiary sulfonium compounds carrying at least one hydrophobic group in the form of a straight or branched aliphatic chain of 5 to 9 carbon atoms and at least one aliphatic substituent carrying an anionic water-solubilizing group represented by carboxy, sulfonate, sulfate, phosphate or phosphonate moieties. Often these products are also called amphoterics or ampholytes, although some publications e.g. Laughlin et al. exclude the quaternaries from the amphoteric classification (U.S. Pat. No. 3,929,678 Column 19).

The zwitterionic surfactants carry positive and negative electrical charge centers in the same molecule. They neutralize each other either intramolecularly or by combining with neighboring molecules of their own kind which could lead to some form of ionic polymeric agglomeration, which probably influences the critical micelle formation. Obviously we deal with complicated systems, particularly in solution.

In an aqueous environment the hydrogen ion concentration or pH has a very pronounced effect on the zwitterions which is believed to be of importance for this invention as will be discussed below. A low pH brings out the cationic and a high pH the anionic characteristics of the compounds. At the isoelectric points the positive and negative charge centers are in equilibrium:

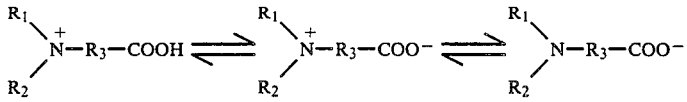

pH 1 Isoelectric Point pH 12

Moving from the isolectric point to the right or left we have mixtures of neutral zwitterions with steadily increasing amounts of negatively or positively charged molecules reaching practically 100% at the high or low pH.

Based on the concept of conjugate base and conjugate acid (Brønsted/Lowry) the relationship between pH and the ionic structure of a zwitterionic surfactant can be expressed through logarithmic form of the mass law by means of the Henderson-Hasselbalch equation. Such calculations can probably be of help in formulating work given that environmental factors of the working solution do not interfere with the results.

Examples of amphoterics in the sense of Laughlin et al are e.g.: N-cocyl glycine, sodium 3-(dodecylamino)-propionate, sodium 3-(dodecylamino)-propane-1-sulfonate, sodium 2-(dodecylamino)ethyl sulfate, sodium 1-carboxymethyl-2-undecylimidazole, and sodium N,N-bis(2-hydroxyethyl)-2-sulfato-3-dodecoxypropylamine, Sodium 3-(dodecylamino)propane-1-sulfonate, and alkyldiaminoethylglycines with long chain alkyls, sodium N-(2-cocylamido-ethyl)-(2-hydroxyethyl)glycine or sodium N-(2-hydroxyethyl)-N-(2-cocylimidoethyl)glycine. Examples for zwitterionic surfactants with quaternary ammonium moieties include, e.g. alkyldimethyl betaines where the alkyl has 12–18 carbon atoms like stearyldimethyl betaine. Furthermore are listed compounds like N,N-dimethyl-N-dodecyl-ammonioacetate and 3-(N,N-dimethyl-N-tetradecylammonio)-2-hydroxy propane-1-sulfonate or 1-(N,N dimethyl-N-carboxyethyl)-3-alkylamido propane where the alkyl group holds 10–18 carbon atoms. Other quaternary ammonium compounds belong to the group of substituted cyclic imidazolimium-1-(2''-ethylcarboxylate) (See U.S. Pat. No. 2,528,378 to Mannheimer and recently revised interpretations by Hits et al. in Parfumarie und Kosmetic #1, pages 16–22 (1983).

TEST PROCEDURES

Performance testing of laundry detergents is difficult since a standardization is not easy to accomplish. Laboratory instruments like the Tergotometer are commonly used for an initial screening, but because of the large number of variables that exist (e.g. see W. G. Spangler on page 420 of the book "Detergency" Part I (1972) edited by W. G. Outler and R. C. Davis) the results can be misleading. Comparison testing was therefore accomplished exclusively with actual home laundry washing machines.

For testing, home laundry equipment and regular mixed wash loads together with standard tests swatches were used for the laundering experiments to take into account the substantial number of variables which influence the laundering. The washing machines which were used in the tests were a top loading reciprocating Frigidaire, and Whirlpool Model LA 7000 WO. The Frigidaire gave the cleaner swatches. A Speed Queen Heavy duty washer gave poor results, at least for the short period it was used. Thus, the most valid comparative tests can only be run by using the same type of washing machine and still better the same machine.

For home laundry uses, the pH of the wash water should be kept in the 5–8 range. Below pH 5 there is danger of corrosion to home washing equipment. Above pH 8, loss of "anticling" or antistatic properties start to occur. The preferred pH range is 5.5 to 7.5 with 6.5 being most preferred for home laundry purposes. In practice, the pH of the wash water does not differ greatly from the formulation and a formulation of pH 5–8 is usual with 6–6.5 being preferred.

The amount of zwitterionic component is at least 10% and usually at least 15–35%. The preferred ratio of zwitterionic (additive) to non-ionic (detergent) components is preferably 20% to 80% up to 80% to 20% by weight for best results in home laundry use.

For convenience, all formulations are given in percent or parts by weight.

When evaluating with test swatches it is important to account for the individual manufacturing series, since the swatches may differ slightly in intensity and in the ease of getting clean either on account of variations due to manufacture or aging or other not necessarily obvious reasons. Consequently each swatch series requires a new standardization against a commercial laundry detergent. Also each new bottle or box bought in the market place must be checked out as a new standard on account of possible variations introduced by the manufacturer.

Since the movement of the test swatches through the wash load is uncontrolled, and in addition the compositions of the load and soil will fluctuate, it is helpful to average the test readings from the five swatches to obtain an overall picture of the cleaning efficiency. In the case of multiple washings with the same detergent, the average detergency figures from the individual launderings are averaged once more for a further refinement of this method. The test results are well reproducible considering the still prevailing variations in load make-up as well as the amount of soil and its composition.

This situation can be further improved by using a clean wash load and using it repeatedly until greying occurs due to soil redeposition. By replacing the natural and varying dirt with the controlled soil from the test fabrics, sharper readings can be obtained of the cleaning power of the detergents. In addition, more tests can be run in a given period of time, since the wash need not be dried between the runs.

The following 5 test swatches were used (supplied by Test Fabrics, Inc. of Middlesex, N.J.).

65/35 Dacron/Cotton

65/35 Dacron/Cotton with resin finish

Spun Dacron Type 54, Cotton 51-s-47
Spun Nylon 6.6

The soil was prepared according to Spec. 51S-47 (INT) Bureau of Ships 1.0 part—ethyl cellulose showing a viscosity of from 8 to 12 centipoises at 25° C. When 5 parts are dissolved in a mixture of 57 parts of toluene (ACS) and 38 parts of ethyl alcohol (ACS)
14.0 parts—naphtha (Esso Marketers' Solvesso #3 is satisfactory)
0.5 parts—butanol
2.0 parts—lamp black, conforming to the requirements of Fed. Spec. TT-L-70 (Grinder's Black #2 is satisfactory)
2.5 parts—hydrogenated vegetable oil conforming to the requirement of Fed. Spec. EE-S-321
20.0 parts—mineral oil (U.S.P.) medicinal grade
0.8 parts—purified sodium alginate (mfg. by the Kelko Co.)
57.1 parts—cold water
1.3 parts—cornstarch
0.5 parts—oleic acid (U.S.P.)
0.3 parts—morpholine solvent The test loads were regular daily laundry which had been sorted for composition to make it as uniform from load to load as was practical. To such a charge in the washer the test swatches were added. After the washing operation, they were removed and dried separately, ironed and mounted for inspection.

The optical readings were taken with a Photovolt Photoelectric Reflection Meter Model 610 using a green tristimulus filter and setting the instrument to read 100% reflection with a standard white enamel plate. The cleaning efficiency was determined by using the standard formula:

$$\text{percent cleaning (or \% Detergency)} = \frac{Rw - Rs}{Ro - Rs} \times 100$$

where Rw represents the reflectance reading of the washed, Rs of the original soiled swatches and Ro of the enamel plate.

Amphoterics Employed in Testing

The following examples are based predominantly on amphoterics derived from substituted imidazolines, specifically from 1-hydroxyethyl-2-alkyl-imidazolines which are manufactured by condensing aminoethylethanolamine (AEEA) with fatty acids or their methyl esters or glycerides. These imidazolines are further reacted with 1,2-olefinic carboxyl acids like acrylic or methacrylic acid or their methyl or ethyl esters. Similar products are obtained when using chloroacetic acid or sodium chloracetate instead.

These amphoterics were described by H. S. Mannheimer in U.S. Pat. No. 2,528,378 (1950) who incorrectly assumed that the final product contained the imidazoline ring. The cyclic structure of the compounds has been rejected in favor of linear structures due to hydrolic fracture of the imidazoline ring under alkaline aqueous conditions. A comprehensive survey over the latest findings has been written by Martin M. Rieger in Cosmetics and Toiletries, Vol. 99, Feb. 1984, pages 61–67.

Depending on the reactants and the reaction conditions, five basic end products can be expected for imidazoline ring derived compounds. These depend on the position of addition of the reactants and the initial or later cleavage of the imidazoline ring. The following 5 reaction schemes illustrate the basic reactions. Specific species used are described in the examples with reference to these reactions.

REACTION 1

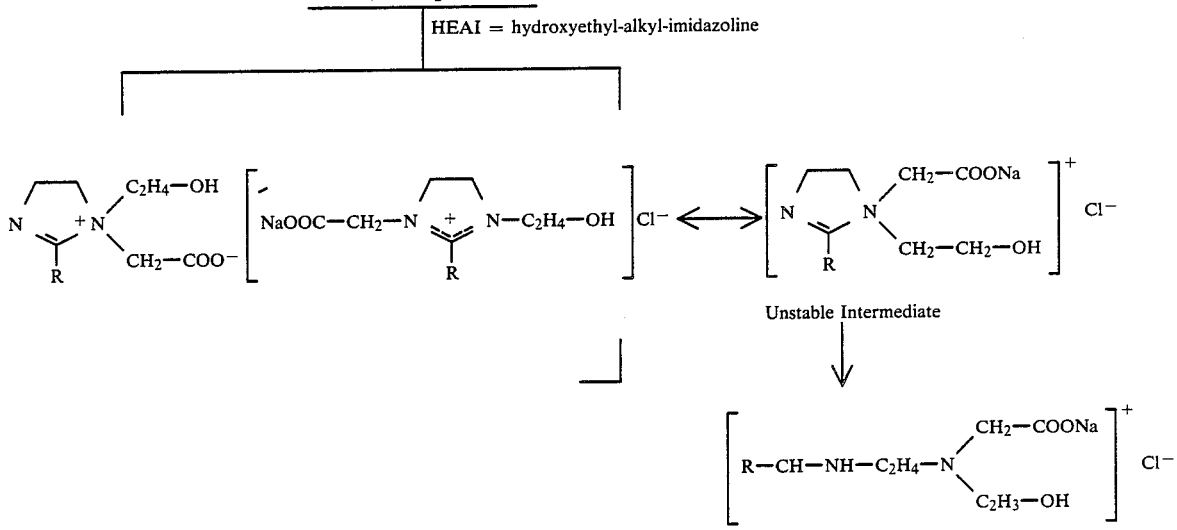

REACTION 2

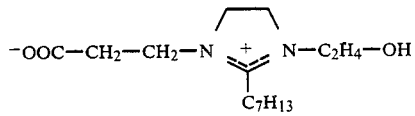

Shows stability in aqueous media (B. G. Harnsberger and J. L. Riebsomer, J. Hetercyclic Chem. 1, 188–192, 1964; Idem 1, 229–232, 1964).

REACTION 3

HEAI + EA or MA
EA = ethylacrylate
MA = methylacrylate

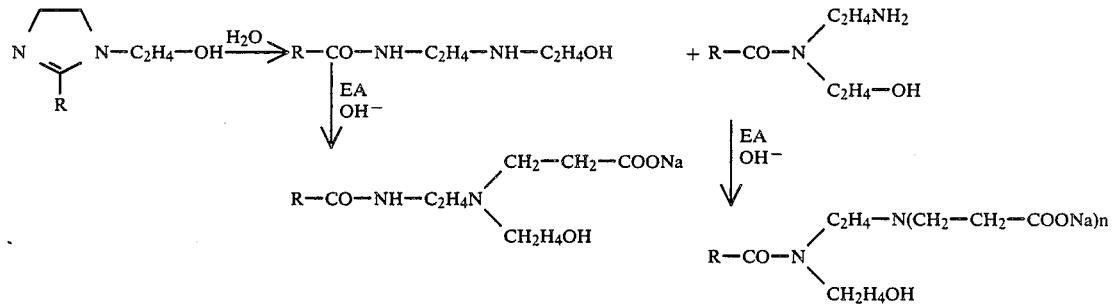

REACTION 4

HEAI + EA or MA at 100 ° C.

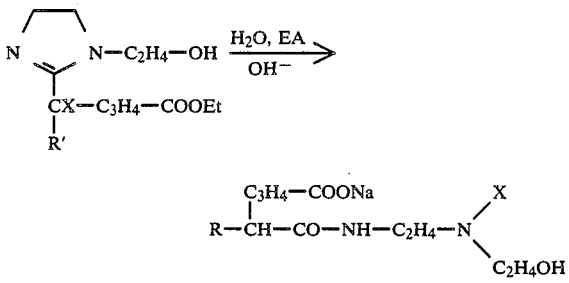

REACTION 5

HEAI + EA or MA + $NaOCH_3$ Catalyst at 40° C.

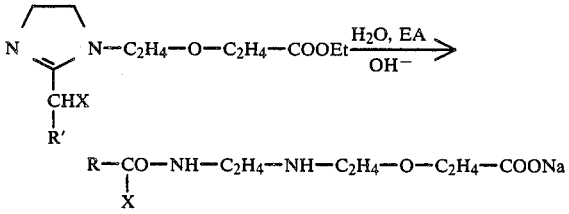

Surfactant molecules containing more than one carboxy group are obtained by reacting appropriate intermediates with available receptive sites with more than one mole, preferably with two moles of chloracetic acid, acrylic acids or their esters.

The above equations give the formulas for the main reaction products. It is expected that many by-products will be produced in minor amounts due to the multiple reactive locations at which reactions can take place.

The fatty acids (R or R′ on the imidazoline ring) which can be used for the manufacture of the short chain imidazolines are e.g. caproic ($C_6$), caprylic ($C_8$) and capric ($C_{10}$) acids from coconut oil, and synthetic ethylhexanoic, heptanoic ($C_7$), pelargonic ($C_9$) and isononanoic ($C_9$) acids, all of which are commercially available. After the cyclization one carbon from the chain will become part of the ring leaving a remaining chain with one less carbon atom.

These acids can be used individually or as is more usual for naturally derived acids, in mixtures of varying combinations. The manufacture of the imidazolines by the condensation of the fatty acids with aminoethylethanolamine (AEEA) is well documented. Since the reactions of the imidazolines with the unsaturated fatty acids, their derivatives or with chloracetic acid leads to a complicated mixture of reaction products, better control over the end products is obtained when an imidazoline of high purity of 90% and over is used for the manufacture of the final amphoterics. However, this control is sometimes unnecessary and acceptable end products are obtained from condensates in which the ring closure to form the imidazolines is substantially lower than 90%. The proportion of unclosed ring compound results in a raw material for the ampholite reaction which contains an amount of amide-amines equivalent to the missing imidazoline percentage.

In a further embodiment of the invention, simpler amphoterics and zwitterionics with quaternary ammonium moieties like glycines and betaines, as described above, but having the long carbon chains replaced by short carbon chains, can also be used in carboxylated, sulfonated or phosphorylated form.

EXAMPLES 1–8

Laundry Equipment: Top loading, reciprocating Frigidaire 12 gallon capacity

Load: Mixed sorted home wash

Water: 250 ppm hardness and pH of 6–7

Test Soil Cloth—from Test Fabrics, Inc.

DETERGENT COMPOSITIONS

| EXAMPLE # | Vol. | °F. | Tergitol NP-9 | Monateric LF-100 | Monateric LF-Na50 | % Active | % Cleaning |
|---|---|---|---|---|---|---|---|
| 1 | 1 oz. | 140 | 100 | | | 100 | 40 |
| 2 | 1 oz. | 140 | | 100 | | 100 | 10 |
| 3 | 1 oz. | 140 | 66.66 | 33.33 | | 100 | 15 |
| 4 | 1 oz. | 140 | 50 | 50 | | 100 | 38 |
| 5 | 1 oz. | 140 | 33.33 | 66.66 | | 100 | 50 |
| 6 | 1 oz. | 140 | 50 | | 50 | 75 | 39 |
| 7 | 1 cup | 140 | Commercial Product #1 | | | | 28 |
| 8 | 2 oz. | 140 | Commercial Product #2 | | | | 47 |

wherein:

Degrees F. is the approximate temperature at which the laundering takes place

Volume (Vol.) is the amount of formulation used while percent Active refers to the purity of the formulation. Less than 100% Active means that a filler or more usually water is present to make up the rest of the volume.

Percent Cleaning (Detergency) is defined above.

Tergitol NP-9 (a trademark of Union Carbide) is a non-ionic surfactant formed of a nonylphenol ethoxylated with 9 moles of ethylene oxide.

Monateric LF-100 (Mona Industries) is made by condensing Emery 1210 (Emery Industries) composed of $C_6$ to $C_9$ fatty acids to obtain a mixture of imidazolines substituted with a 2-hydroxyethyl group in the 1-position and holding the hydrocarbon chains with $C_5$ to $C_8$ carbon atoms in the 2-position. Treatment with methylacrylate yields the amphoteric according to Reaction #4 above. The Monateric LF-100 when dispersed in water will immediately hydrolyze according to Reaction #4 (Example #2). When dissolving the mixtures of Examples #3, 4 and 5 the Monateric LF-100 will likewise hydrolyze with ring opening.

Monateric LF-Na50 is a zwitterionic surfactant obtained from the Monateric LF-100 and breaking the imidazoline ring with aqueous sodium hydroxide according to Reaction #4 above.

When observing the Examples 1, 3, 4 and 5 one notices that small amounts of ampholite added to the nonionic surfactant decreases substantially the cleaning power of the Tergitol NP-9 and that positive synergism does not exert itself unless the amount of the ampholite exceeds that of the nonionic. This is not the rule, however, with this versatile invention. The condition is reversed, e.g. in

EXAMPLES 9

Emulphogene BC-610—60%

Monateric PLG-MLT-50—40% (50% active)

A laundering with 1 ounce of this detergent at 140° F. under the washing conditions described for Examples 1-9 resulted in 42% cleaning. Whereas the ratio of nonionic/amphoteric in Example 3 is 2:1, the ratio in Example 9 is only 3:1. In addition this result was achieved with a detergent of only 80% activity.

The following examples show the use of Monateric, (zwitterionic surfactant) additives made from imidazolines using individual short chain fatty acids instead of mixtures thereof. They originate from the fractional distillation of coconut fatty acids or from synthetic processes.

EXAMPLES 10-17

Laundry Equipment: Top loading, reciprocating Frigidaire 12 gallon capacity

Load: Mixed sorted home wash

Water: 250 ppm hardness and pH of 6-7

Test Soil Cloth—from Test Fabrics, Inc.

| | | | | DETERGENT COMPOSITIONS | | | | | | | |
|---|---|---|---|---|---|---|---|---|---|---|---|
| | | | | MONATERIC SURFACTANTS | | | | | | | |
| EXP # | Vol. | °F. | Tergitol NP-9 | HEP-MM-A50 | PLG--A50 | PLG-MM-A50 | PLG-MLT-A50 | Cy-Na50 | $H_2O$ | % Act. | % Cleaning |
| 10 | 2 oz. | 140 | 50 | 100 | | | | | 50 | 50 | 46 |
| 11 | 2 oz. | 140 | 50 | | 100 | | | | 50 | 50 | 44 |
| 12 | 2 oz. | 100 | 50 | | 100 | | | | 50 | 50 | 48 |
| 13 | 2 oz. | 100 | 50 | | | 100 | | | 50 | 50 | 45 |
| 14 | 2 oz. | 140 | 50 | | | 100 | | | 50 | 50 | 48 |
| 15 | 2 oz. | 140 | 50 | | | | 100 | | 50 | 50 | 41 |
| 16 | 2 oz. | 140 | | 33 (Mixture of nonionics) | | | | 49 | 82 | 50 | 43 |
| 17 | 2 oz. | 140 | | Commercial Product #2 | | | | | | | 45 |

The Monateric HEP-MM-A50 ($C_6$ carbon chain, Reactions #3 with 2 moles methyl acrylate) and the Monaterics PLG-A50, PLG-MM-A50 and PLG-MLA50 ($C_8$ carbon chains, Reaction #3, with 2 moles methyl acrylate and Reactions #3 and #5 respectively) are based on heptanoic and pelargonic acids (Celanese Corp.) Reaction #2 was used in the preparation of the Monateric CY-Na50 which is the 50% concentrated sodium salt of the caprylic acid derivate ($C_7$ chain).

Example 18 is represented by a phosphoteric (U.S. Pat. No. 4,490,536—Mona Ind.) which is based on a hydroxyethylimidazoline made with 3,5,5-trimethylhexanoic acid (isononanoic acid—Hoechst) which had been reacted with 2 moles methylacrylate according to Reaction #4 followed by a treatment with polyphosphoric acid.

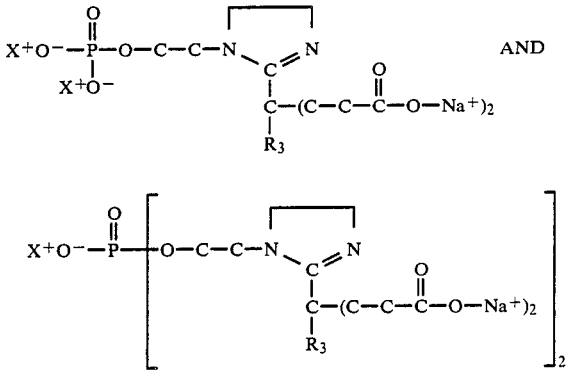

AND

X = $H^+$ or $Na^+$
$R_3$ = $C_8$

EXAMPLE 18

| | |
|---|---|
| Isononanoic Phosphoteric 35% | 49.0% |
| Tergitol NP-9 | 12.5% |
| Tergitol NP-6 | 12.5% |
| Monamid 1078 (Coconut Diethanolamide) | 8.0% |
| Water | 18.0% |

This product is 50% active and when used in 2 ounce amounts at 140° F. in the 12 gallon Frigidaire gave a 41% cleaning result.

The search for better cotton cleaning led to EXAMPLES 19 and 20 by broadening the simple compositions of EXAMPLES 1 to 16 using a mixture of nonionics including a diethanolamide. They are good washing detergents which leave the laundry clean smelling, soft and cling free, the whites white and the colors bright and no greying due to soil redeposition, and producing cottons with outstanding water absorbing power as shown by the Holland Wick-Up Test as shown on Terry cloth.

EXAMPLE 19

| | |
|---|---|
| Monateric PLG-A50 | 37.0% |
| Tergitol NP-9 | 27.2% |
| Tergitol NP-6 | 27.2% |
| Monamid 705 (Coconut Diethanolamide) | 8.6% |

EXAMPLE 20

| | |
|---|---|
| Monateric PLG-MLT-A50 | 17.4% |
| Water | 50.1% |
| Tergitol TMN-6 | 13.0% |
| Emulphogene BC-610 | 13.0% |
| Monamid 1087 (Coconut Diethanolamide) | 6.5% |

Tergitol TMN (a trademark of Union Carbide) is 2,6,8-trimethylnonanol ethoxylated with 6 moles of ethyleneoxide. Emulphogene BC-610 (GAF Corp.) is tridecyloxypoly(ethylene)ethanol.

EXAMPLES 19-26

Laundry Equipment: Whirlpool-Model LA-7000 WO-20 gallon capacity

Load: Mixed sorted home wash

Water: 250 ppm hardness and pH of 6-7

Test Soil Cloth—from Test Fabrics, Inc.

DETERGENT COMPOSITIONS EXAMPLES 19 to 22

| EXAMPLE # | Vol. | °F. | % Activity | % Cleaning |
|---|---|---|---|---|
| 19 | 1 oz. | 140 | 81 | 48 |
| 19 | 1 oz. | 90 | 81 | 43 |
| 20 | 1 oz. | 140 | 41 | 40 |
| 20 | 1 oz. | 90 | 41 | 37 |
| 21 | 8 oz. | 140 | Commercial Product #3 | 45 |
| 21 | 8 oz. | 90 | Commercial Product #3 | 46 |
| 22 | 4 oz. | 140 | Commercial Product #4 | 44 |

-continued

DETERGENT COMPOSITIONS EXAMPLES 19 to 22

| EXAMPLE # | Vol. | °F. | % Activity | % Cleaning |
|---|---|---|---|---|
| 22 | 4 oz. | 90 | Commercial Product #4 | 37 |

EXAMPLE 23

Soil Redisposition 13 consecutive launderings were made using as detergent EXAMPLE 19 and the above described washing procedures. Setting the original five test swatches individually at 100% reflection the following losses were observed.

| Swatch # | | | | |
|---|---|---|---|---|
| 1 | 2 | 3 | 4 | 5 |
| 2% | 0% | 1% | 3% | 4% |

EXAMPLE 24

Soil Redeposition

A swatch #2 was carried through 200+ washes, using the detergent Formula 19 and many other experimental compositions. A final whiteness loss of only 4% was observed.

It will be understood that the specification and examples are illustrative but not limitative of the present invention and that other embodiments within the spirit and scope of the invention will suggest themselves to those skilled in the art.

What is claimed is:

1. The surfactant detergent formulation which contains, by weight:

37.0% of the reaction product at 100° C. of 1 mole of 1-hydroxyethyl-2-octylimidazoline with 1 mole of methacrylate and following saponification with an amount of water to give a 50% concentration of the resulting amphoteric surfactant, 27.2% of a nonionic surfactant obtained from nonylphenol ethoxylated with 9 moles of ethylene oxide, 27.2% of a nonionic surfactant obtained from nonylphenol ethoxylated with 6 moles of ethylene oxide, and 8.6% of coconut diethanolamide.

* * * * *